US012286209B2

(12) United States Patent
Avlasenko

(10) Patent No.: US 12,286,209 B2
(45) Date of Patent: Apr. 29, 2025

(54) STEERABLE AND RETRACTABLE PADDLE-WHEEL MECHANISM FOR PROPELLING A BOAT

(71) Applicant: Aleksandr Avlasenko, Riga (LV)

(72) Inventor: Aleksandr Avlasenko, Riga (LV)

( * ) Notice: Subject to any disclaimer, the term of this patent is extended or adjusted under 35 U.S.C. 154(b) by 482 days.

(21) Appl. No.: 17/755,543

(22) PCT Filed: Nov. 5, 2019

(86) PCT No.: PCT/IB2019/059480
§ 371 (c)(1),
(2) Date: May 1, 2022

(87) PCT Pub. No.: WO2021/090044
PCT Pub. Date: May 14, 2021

(65) Prior Publication Data
US 2022/0380010 A1 Dec. 1, 2022

(51) Int. Cl.
*B63H 5/03* (2006.01)
*B63H 16/08* (2006.01)
*B63H 21/17* (2006.01)
*B63H 25/02* (2006.01)

(52) U.S. Cl.
CPC ..... *B63H 5/03* (2013.01); *B63H 16/08* (2013.01); *B63H 21/17* (2013.01); *B63H 25/02* (2013.01)

(58) Field of Classification Search
CPC ..... B63H 5/03; B63H 16/08; B63H 21/17
See application file for complete search history.

(56) References Cited

U.S. PATENT DOCUMENTS

| | | | | | |
|---|---|---|---|---|---|
| 1,540,259 | A * | 6/1925 | Dravo | B63H 5/02 | 440/90 |
| 2,294,104 | A * | 8/1942 | Waddington | B63H 1/06 | 440/90 |
| 2,711,708 | A * | 6/1955 | Thornburg | B63H 5/02 | 440/91 |
| 3,170,437 | A * | 2/1965 | Kilmer | B63H 5/03 | 440/5 |
| 5,988,092 | A * | 11/1999 | Price | B63H 25/38 | 440/91 |
| 6,264,518 | B1 * | 7/2001 | Price | B63H 25/38 | 440/91 |
| 6,814,636 | B2 * | 11/2004 | Nolen | B63H 5/02 | 440/90 |
| 7,448,930 | B2 * | 11/2008 | Diggins | B63H 1/04 | 440/90 |
| 2020/0391830 | A1 * | 12/2020 | Gertsch | B63H 16/20 | |

* cited by examiner

*Primary Examiner* — S. Joseph Morano
*Assistant Examiner* — Jovon E Hayes
(74) *Attorney, Agent, or Firm* — Patshegen IP; Moshe Pinchas

(57) ABSTRACT

Invention relates to the paddle-wheel propelling mechanisms, especially to the steerable and retractable paddle-wheel mechanisms for propelling boats. The paddle-wheel propulsion and steering mechanism comprises a frame structure for securing the mechanism to the boat; a propulsion mechanism for propulsion of the boat; a paddle-wheel upward and downward moving mechanism for movement of the paddle-wheel relative to a waterline of the boat; and a steering mechanism for steering of the boat.

8 Claims, 13 Drawing Sheets

STEERABLE AND RETRACTABLE PADDLE-WHEEL MECHANISM FOR PROPELLING A BOAT

FIELD OF INVENTION

Invention relates to the paddle-wheel propelling mechanisms, especially to the steerable and retractable paddle-wheel mechanisms for propelling boats.

BACKGROUND OF INVENTION

The U.S. patent publication ser. No. 520,944 (J. C. Thomas) discloses a paddle wheel mechanism for propelling boats, wherein the paddle wheels are mounted on independent shafts and the sleeves having the bevel gears adapted to be shifted longitudinally on said shafts, and revolve with them. The bevel gears mounted on shafts having their bearings in stands with the gear adapted to mesh with either of the gears at certain times.

The U.S. Pat. No. 3,148,656 discloses a boat propulsion system, wherein the system comprises a frame including a pair of spaced parallel frame members, legs arranged angularly with respect to said frame members and secured thereto, a support section pivotally connected to said frame and including a pair of spaced parallel support pieces, a pair of paddle units detachably connected to said support section, a base section including a pair of spaced apart bars pivotally connected to said frame members, foot pedals operatively connected to said base section, drive means operatively connected to said foot pedals and supported in said frame, and means operatively connecting said drive means to said paddle units.

The U.S. Pat. No. 1,551,360 discloses a propelling device for boats, comprising a pair of shafts pivotally supported on the gunwales of the boat, a sprocket gear carried by each of said shafts and arranged on the outside of the gunwales, a second pair of shafts one pivoted on each side of the boat adjacent the water line thereof, a second pair of sprockets one carried by each of said second mentioned shafts, chains connecting said first mentioned sprockets to said second mentioned sprockets', a paddle wheel carried by each of said second mentioned shafts, and means for rotating said first mentioned shafts for rotating said paddle wheels.

The U.S. Pat. No. 6,264,518 discloses a propulsion and steering system consisting of a paddle wheel, a power supply, a clutch, a gear reduction system to transfer power to the paddle wheel, an optional splash guard mounted between the stern of the boat and the paddle wheel, a frame to attach the propulsion members to the boat and a rudder mounted to the bow of the boat. The paddle wheel comprises blades secured to angled spokes at an angle skewed to the axis of rotation of the paddle wheel rather than extending radially from the axis of rotation of the centre hubs to effect vertical lift. The steering apparatus comprises the rudder mounted at the bow of the boat and being formed and arranged to pivot freely about a horizontal axis in a vertical direction as well as pivot horizontally about a vertical axis.

Aim of the invention is to design a boat, which provides very effective transmission of applied power into propelling of the boat, high maneuverability, as well as ability to navigate in shallow waters.

SUMMARY OF INVENTION

Aim of the invention is reached by design of a paddle-wheel propulsion and steering mechanism, which is attachable to a boat to provide its propulsion and steering.

The paddle-wheel propulsion and steering mechanism comprises of the following main units: frame structure for securing the mechanism to the boat; a propulsion mechanism for propulsion of the boat; a paddle-wheel upward and downward moving mechanism for movement of the paddle-wheel relative to a waterline of the boat; and a steering mechanism for steering of the boat.

The frame structure itself consists of two main parts: a first frame structure and the second frame structure.

The first frame structure comprises a frame and an adapter connected to the frame. The adapter may has telescopic design so that the first frame structure may be attachable the boats of different configurations, mainly to the boats with different width. The first frame structure is positioned transversely to the longitudinal axis of the boat. The first frame structure is designed so that it supports one part of the propulsion mechanism and the steering mechanism.

The second frame structure attached to and position transversely to the first frame structure. Preferably, the second frame structure is aligned with the longitudinal axis of the boat. The second frame structure is designed so that it supports another part of the propulsion mechanism and the steering mechanism.

The propulsion mechanism comprises the following main elements of the mechanism: a drive unit; a central drive shaft; two alignment shafts on each side of the central drive shaft; two side drive shafts on each side of the central drive shaft; a clutch mechanism for selectively engaging the central drive shaft with the side drive shaft; two side paddle-wheel transmission mechanisms on each side (port and starboard side) of the boat.

The central drive shaft is connected to the frame structure by means of at least two bearing flanges. The central drive shaft at each end thereof comprises a threaded portion and a splines portion. A central flange mount is mounted onto the central drive shaft and configured to fix a driven sprocket thereto.

The drive unit is connected to the central drive shaft via the driven sprocket of the central flange mount and configured to rotate of the central drive shaft.

In one embodiment, the drive unit is a chain drive unit comprising a roller chain, a driving sprocket attached to pedals and a driven sprocket. In other embodiments, the drive unit may be a belt drive unit, a cardan drive unit or a gear drive unit. The cardan drive comprises cardan joint that is also known as a universal joint. The chain drive unit, the belt drive unit, the gear drive unit and the cardan drive unit may be powered by an electric motor or by a muscle power of a user of the boat.

One end of each alignment shaft of the propulsion mechanism is screwed into the one end of the central drive shaft.

Each side drive shaft is mounted to the frame structure by means of at least two bearing flanges and wherein each side drive shaft is hollow so that it accommodates the alignment shaft so that the side drive shaft may rotate independently of the alignment shaft. The alignment shaft is fixed but the side drive shaft is arranged to rotatable so that the propulsion of the boat may be performed. Preferably, the alignment shaft is arranged concentric to the side drive shaft. The side drive shaft is operatively connected to the central drive shaft via the clutch mechanism. The clutch mechanism is configured to operatively connect or disconnect the central drive shaft to/form each of side drive shafts.

In one of the embodiments, the clutch mechanism comprises an adjustment nut screwed onto the threaded portion of the central drive shaft; a cup mounted onto the central drive shaft; a support spring mounted onto the central drive shaft and arranged within the cup; a releaser with a guide sleeve mounted onto the cup so that upon the movement of the guide sleeve the cup is movable along the longitudinal axis of the central drive shaft; a drive flange mounted onto the splines of the central drive shaft, the drive flange further comprises a friction disc and the drive flange is secured onto the central drive shaft by means of a support nut; a driven flange fixed to the side drive shaft, wherein the driven flange comprises a flange bearing to provide support of the driven flange on the alignment shaft.

The propulsion mechanism further comprises two drive shaft sprocket flanges with a sprocket of each drive shaft sprocket flange. Each drive shaft sprocket flange is fixed to the another end of the side drive shaft transferring rotation of the side drive shaft to the drive shaft sprocket flange.

The propulsion mechanism further comprises a support bearing positioned at the another end of each alignment shaft to support thereof.

The propulsion mechanism in cooperation with the paddle-wheel upward-downward moving mechanism comprises two side upward-downward moving mechanism tubes. Each side upward-downward moving mechanism tube is supported onto the respective side drive shaft by means of bearings positioned on each end of the side upward-downward moving mechanism tube and the side drive shaft. The side upward-downward moving mechanism tube may rotate independently of the side drive shaft and the alignment shaft. The side upward-downward moving mechanism tube is arranged concentric to the side drive shaft and the alignment shaft. Each side paddle-wheel transmission mechanism comprises an arm with one end fixed to the respective side upward-downward moving mechanism tube and with another end rotatably connected to a paddle wheel. The paddle wheel comprises paddles set around the periphery of the paddle-wheel. Number of paddle-wheels may be defined by predetermined use of the boat or size of the boat. In one embodiment, the paddle wheel may comprise six paddles. In another embodiment it may has eight paddles. The paddle-wheel further comprises a paddle wheel sprocket fixed to the paddle wheel by means of bolts and operatively connected to the sprocket of the drive shaft sprocket flange sprocket so that the rotation of the sprocket of the drive shaft sprocket flange is transferred to the paddle wheel sprocket and further to the paddle wheel.

The design of the mechanism, where the alignment shaft is concentrically positioned within the side drive shaft, and the side drive shaft is concentrically positioned within the two side upward-downward moving mechanism tubes makes propulsion, steering and up and down moving paddle-wheel mechanism very compact. Hence, it may be installed even on very small boats. Each of aforementioned three shafts can rotate independently from each other, making this mechanism versatile and compact.

The propulsion mechanism operates so that the torque from the drive unit is transferred to the central drive shaft, where it is transferred further to the side drive shaft via a clutch mechanism. From the side drive shaft the torque is transferred to sprocket of the drive shaft sprocket flange and further to the paddle wheel.

The paddle-wheel upward-downward moving mechanism comprises a shaft of the paddle-wheel upward-downward moving mechanism. The shaft is connected to the frame structure by means of at least two bearing flanges and arranged parallel to the central drive shaft. The mechanism further comprises two flange mounts with a sprocket on each flange mount, wherein each flange mount with a sprocket is fixed on each end of the shaft of the paddle-wheel upward-downward moving mechanism. Each flange mount with the sprocket is connected to a respective sprocket mounted onto the flange of the side upward-downward moving mechanism tube by means of a chain so that the side upward-downward moving mechanism tube can be rotated by the rotation of the a shaft of the paddle-wheel upward-downward moving mechanism.

The paddle-wheel upward-downward moving mechanism further comprises a yoke with a lever and fixation button. The yoke is fixed to the shaft of the paddle-wheel upward-downward moving mechanism. The paddle-wheel upward-downward moving mechanism further comprises a shaft fixation segment fixed to the shaft, and a frame fixation segment fixed to the frame structure. The shaft fixation segment and the frame fixation segment are arranged to provide fixation of the shaft of the paddle-wheel upward-downward moving mechanism after certain rotation of the shaft by means of the yoke.

In other embodiments, the yoke of the paddle-wheel upward-downward moving mechanism is provided with an electrical or hydraulic power to augment upward-downward moving effort. This helps the user of the boat to move up or down the paddle-wheel with less effort needed. The steering mechanism comprises a main steering shaft connected to the second frame structure via at least two flange bearings. The main steering gear comprises one end and another end equipped with a fork of the main steering shaft.

The steering mechanism further comprises a steering lever fixed to one end of the main steering shaft. The steering mechanism further comprises two steering rods. One end of each steering rod is connected to the fork of the main steering shaft and another end of each steering rod is connected to the guide sleeve. The steering lever is fixed to one end of the main steering shaft so that the up or down movement of the steering lever is transferred to the main steering shaft as a rotation thereof and rotation of the main steering shaft via the fork of the main steering shaft is transferred as a linear movement to the respective steering lever, where the respective steering lever controls the guide sleeve in order to engage or disengage the clutch mechanism. The steering is performed by engagement and disengagement of the central drive shaft with the side drive shafts via clutch mechanism.

In other embodiments, the steering lever of the steering mechanism is provided with an electrical or hydraulic power steering to augment steering effort. This helps the user of the boat to move the steering lever with less effort needed.

The steerable and retractable paddle-wheel mechanism may be installed on different kind of vessels, such as on inflatable boats, wooden boats, plastic boats, metal (aluminium) boats. The mechanism may be installed also on catamarans, floats or pontoons.

BRIEF DESCRIPTION OF DRAWINGS

The figures provided below give a detailed description of the invention.

DETAILED DESCRIPTION OF INVENTION

Figure 1:
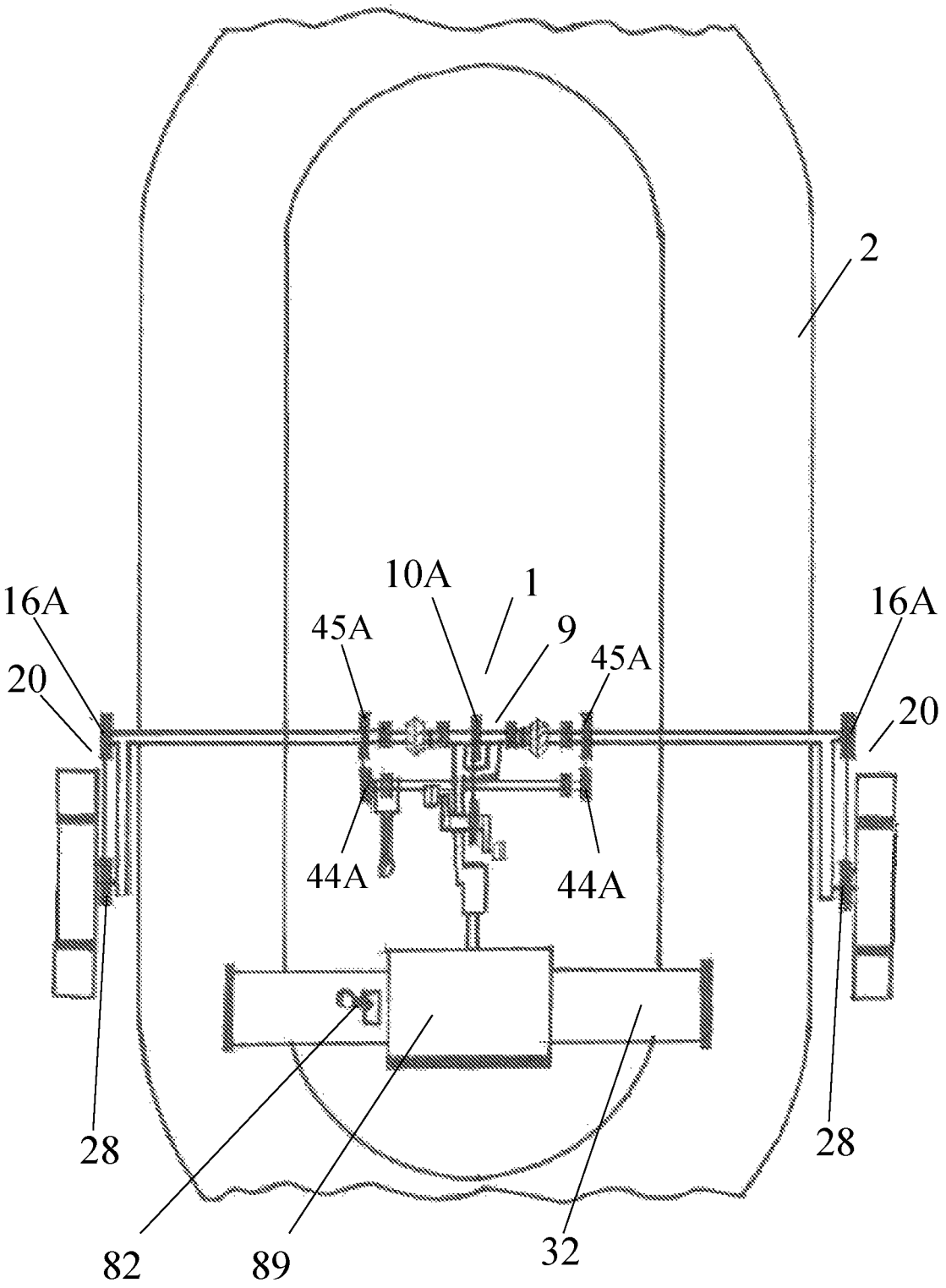
FIG. 1 is a top view of a boat 2 comprising a paddle-wheel mechanism 1.

In one embodiment of the invention the paddle-wheel propulsion and steering mechanism 1 is installed on the inflatable boat 2 (see FIGS. 1, 2A, 2B, 3). The mechanism 1 comprises the following main units: the first frame structure 30; the second frame structure 30; the propulsion mechanism 9; two side paddle-wheel transmission mechanisms 20 on each side of the propulsion mechanism 9; and a paddle-wheel upward-downward moving mechanism 40.

Figure 3:
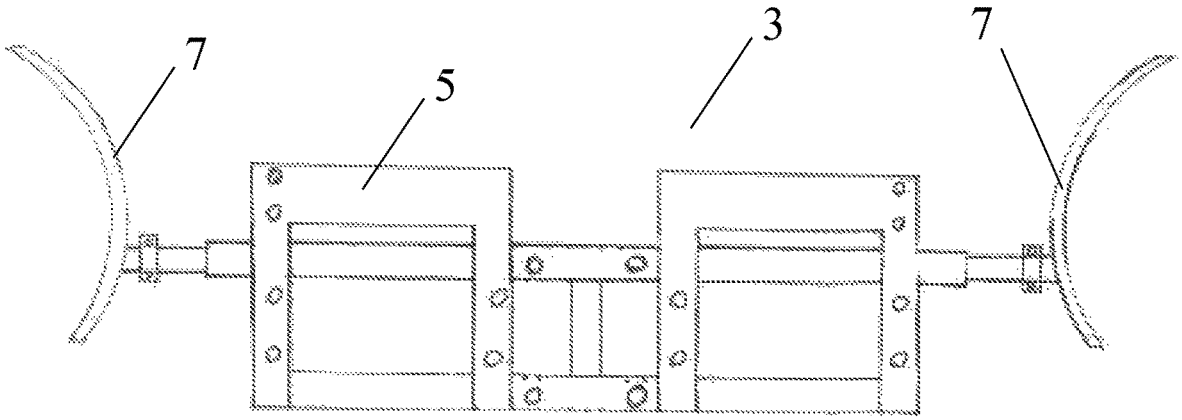
FIG. 3 is a side view of the frame structure 3.

The first frame structure 3 comprises the frame 5 and two adapters 7 slidably connected to the frame 5 (see FIG. 3). The adapters 7 has telescopic design or is slidable relative to the frame 5 so that the first frame structure 3 may be adapted to the size or width of the inflatable boat 2. The adapter 7 at the end, that bears against the hull of the boat 2, has such a shape (half-moon shape) that fits with the hull of the boat 2. Hence, secure connection between the first frame structure 3 and the boat 2 can be made.

Figure 13:
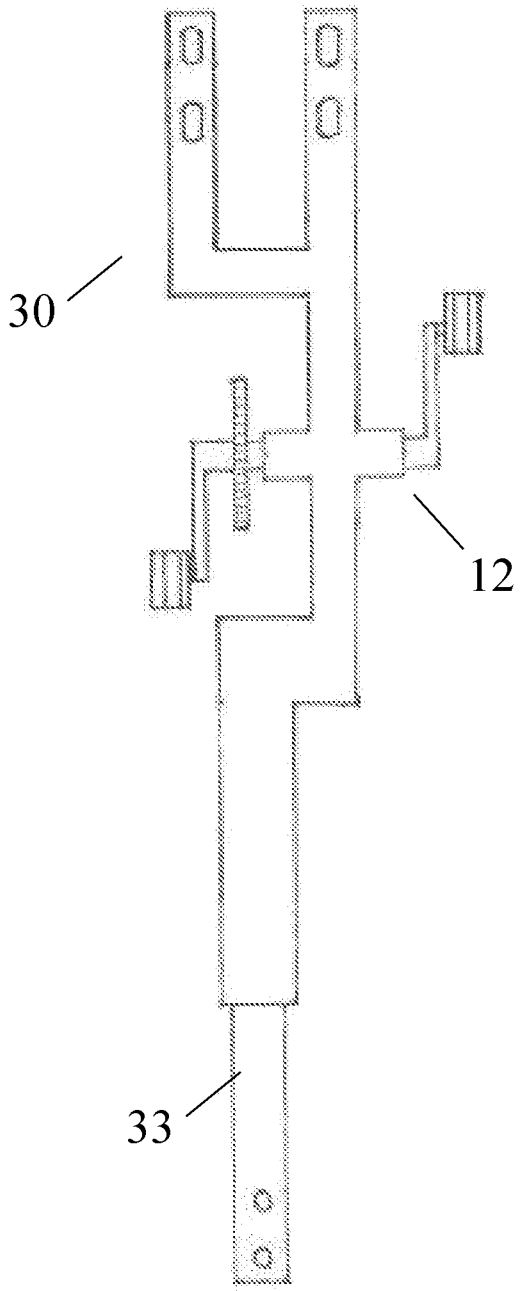
FIG. 13 illustrates the second frame structure 30.
Figure 14A:
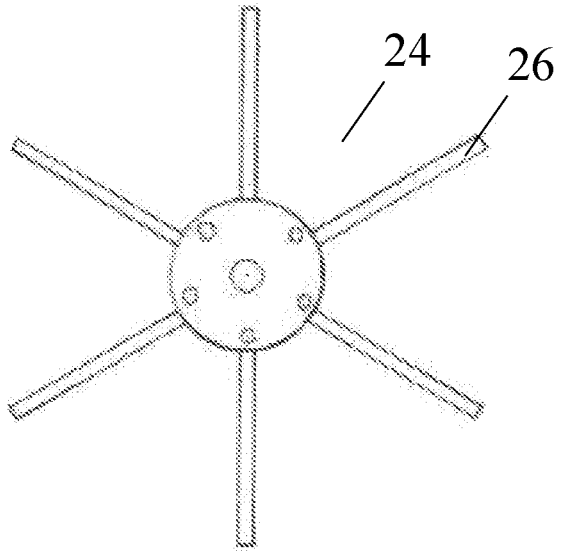
FIG. 14A is a side view of the paddle-wheel 24.
Figure 14B:
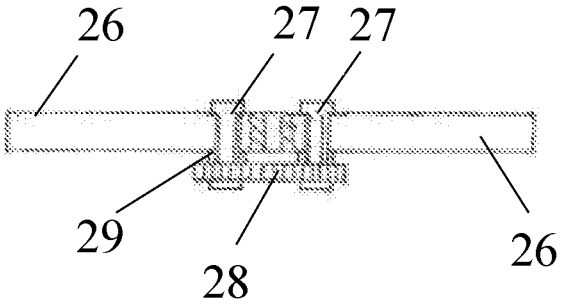
FIG. 14B is a top view of the paddle-wheel 24.
Figure 15:
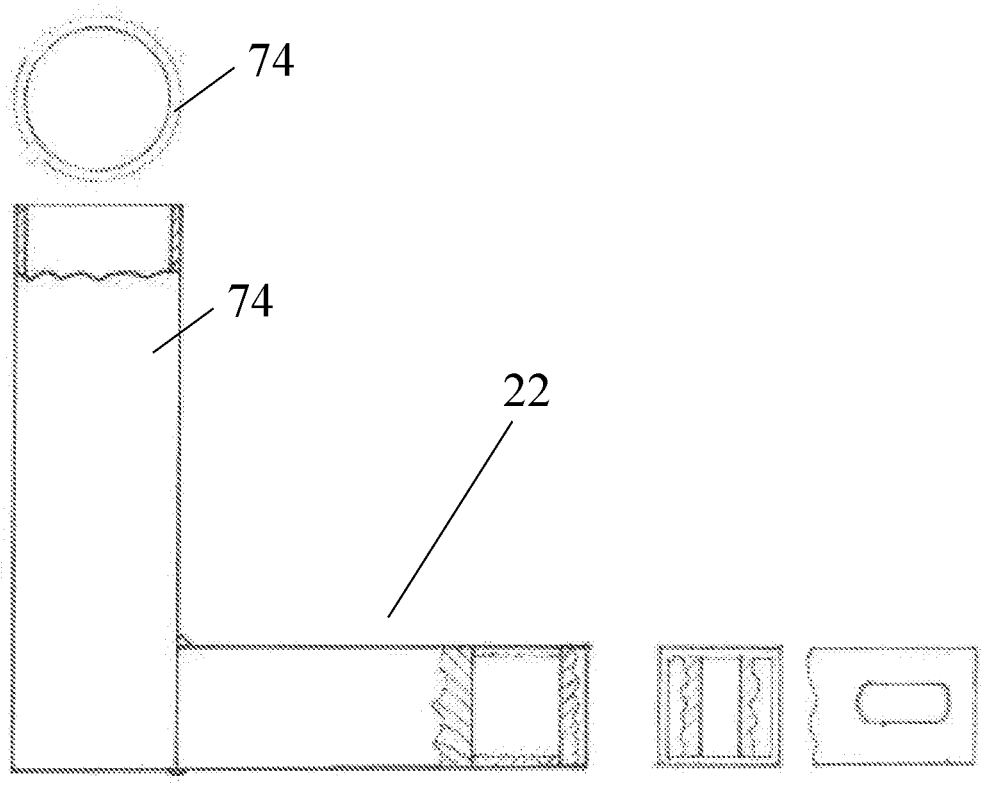
FIG. 15 illustrates the arm 22 of the paddle-wheel upward-downward moving mechanism with its cross-sections.
Figure 18:
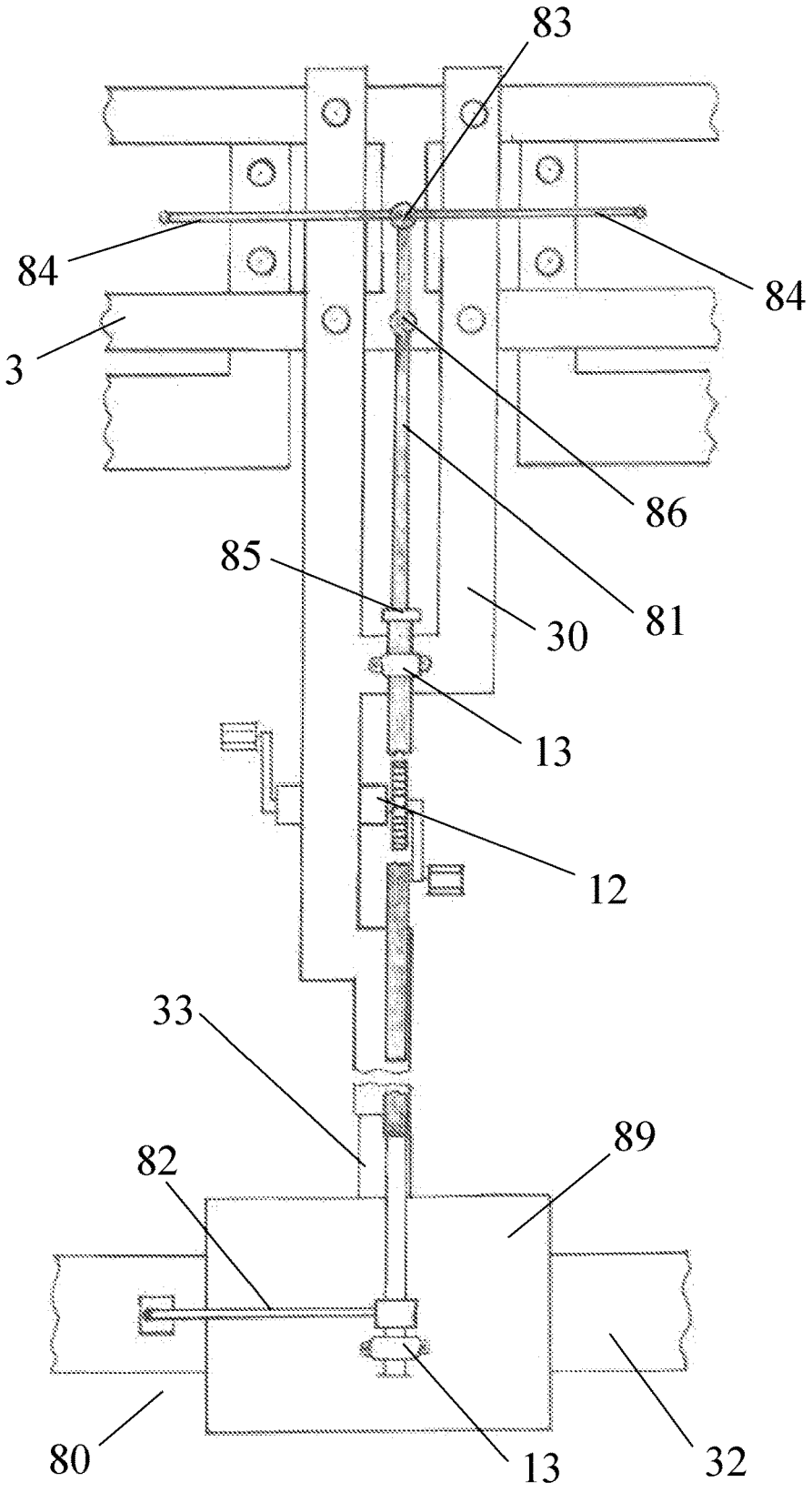
FIG. 18 illustrates the second frame structure 30 attached to and position transversely to the first frame structure 3.
Figure 19A:
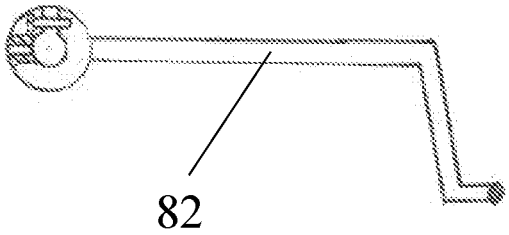
FIG. 19A is a side view of the steering lever 82.
Figure 19B:
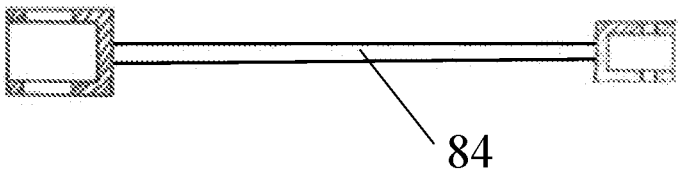
FIG. 19B is a side view of the steering rod 84 with cut-out sections.
Figure 19C:
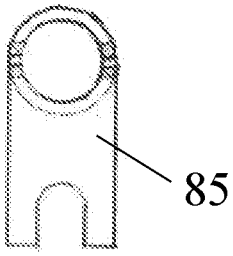
FIG. 19C is a front view of the support 85 of the main steering shaft 81.
Figure 19D:
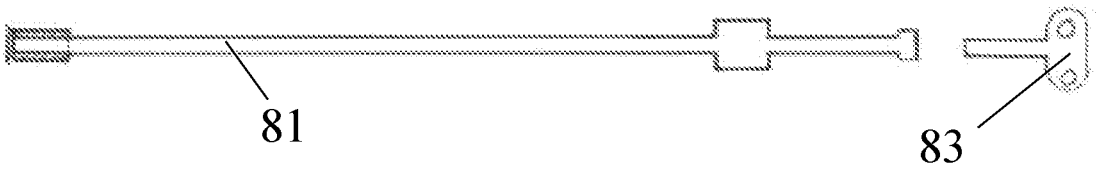
FIG. 19D is a top view of the main steering wheel 81.
Figure 20A:
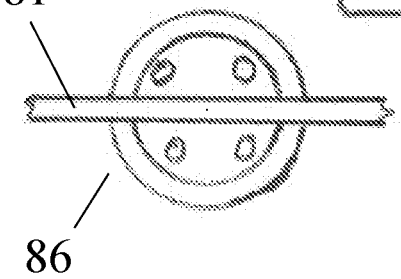
FIG. 20A is a top view of the auxiliary support 86 of the main steering shaft 81.
Figure 20B:
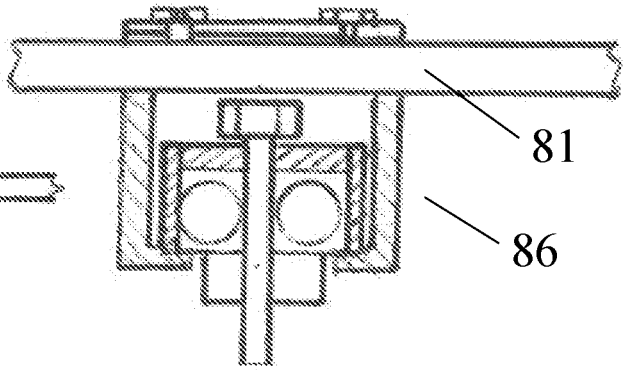
FIG. 20B is a cross section view of the support 86 of the main steering shaft 81 as seen in FIG. 20A.

The second frame structure 30 with one end is attached to first frame structure 3 and positioned transversely to said second frame structure 30 (FIG. 18). The support bar 32 is attached at another end of the second frame structure 30. The support bar 32 is adaptable to the width of the boat 2 to facilitate its positioning and support onto the boat 2 (see FIGS. 1, 13 and 18). The frame structure 30 further comprises a telescopic tube 33 configured to be adaptable to the length of the user of the boat 2 so that the distance between the seat 89 and the drive unit 12 is the form of pedal drive may be adjustable.

Figure 4:
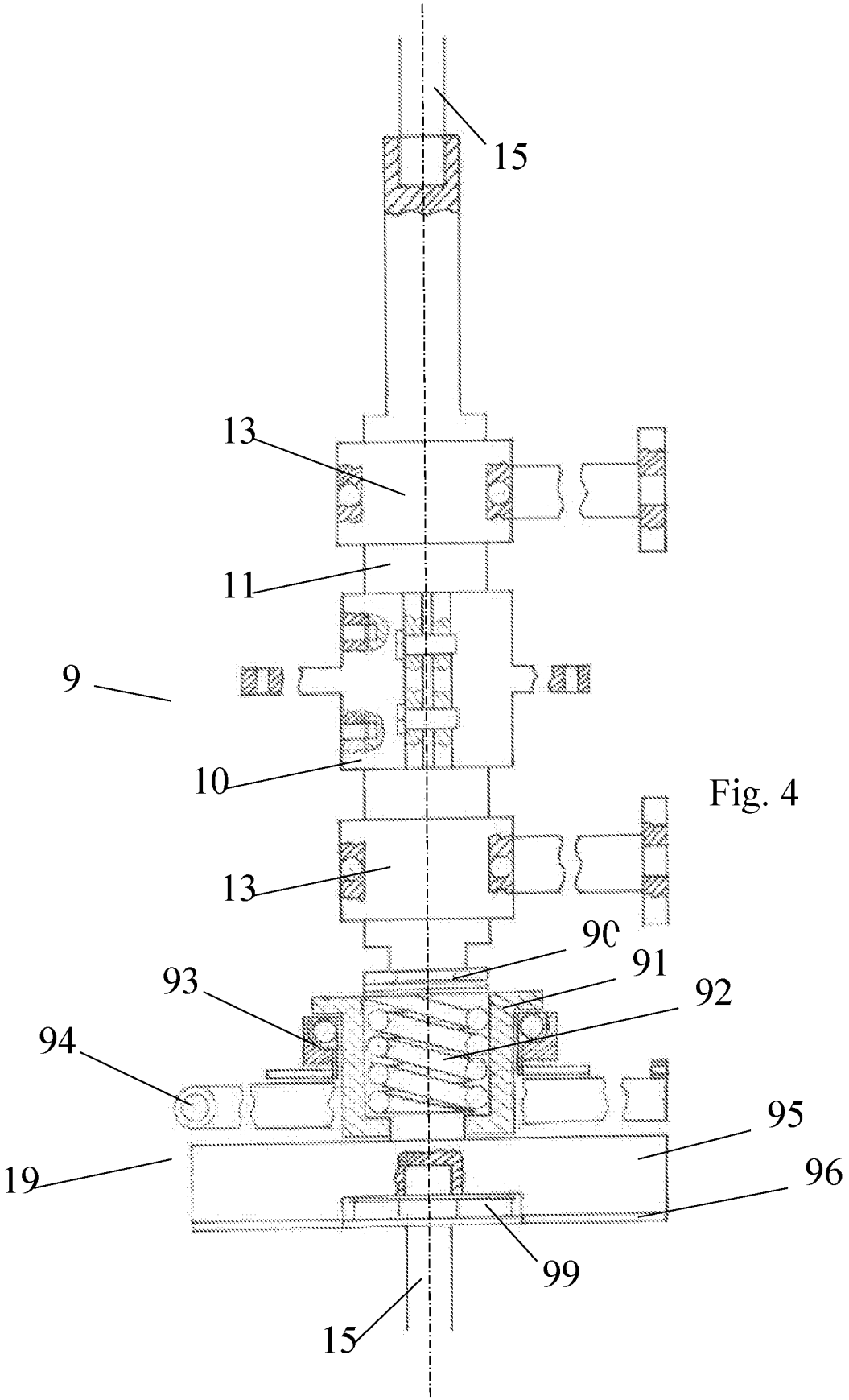
FIG. 4 illustrates one part of the drive mechanism 9.
Figure 9A:
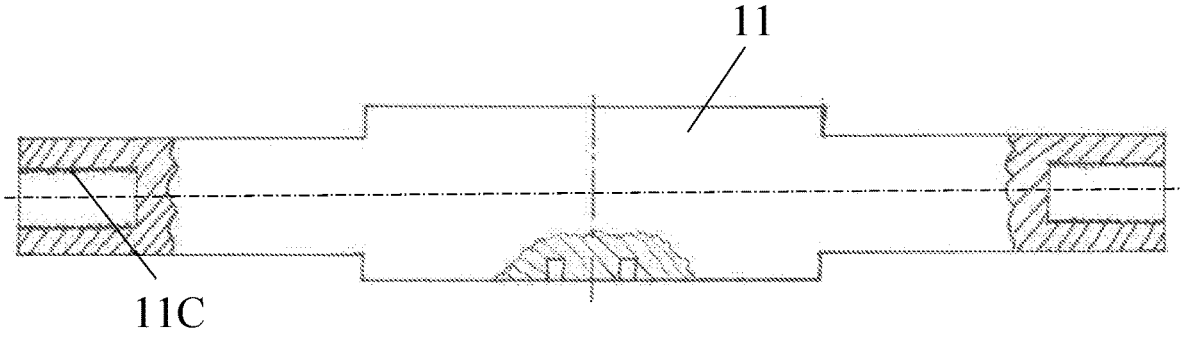
FIG. 9A illustrates a central drive shaft 11 with threaded bores 11C on each end thereof.
Figure 9B:
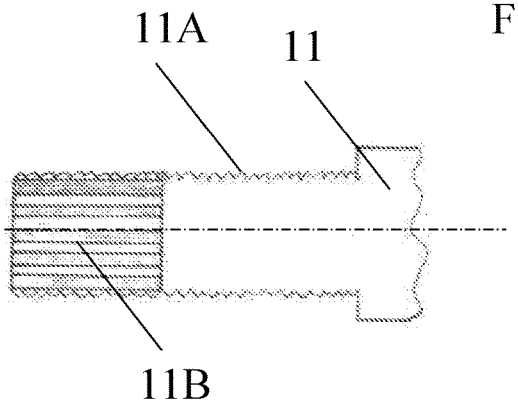
FIG. 9B is the one end of the central drive shaft 11 with the thread section 11A and splines section 11B.
Figure 10A:
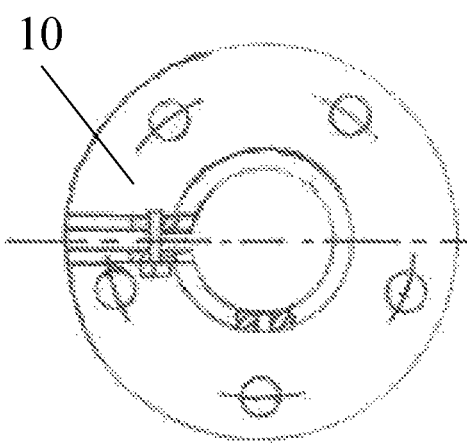
FIG. 10A is a front view of the sprocket flange 10 for mounting the sprocket thereto.
Figure 10B:
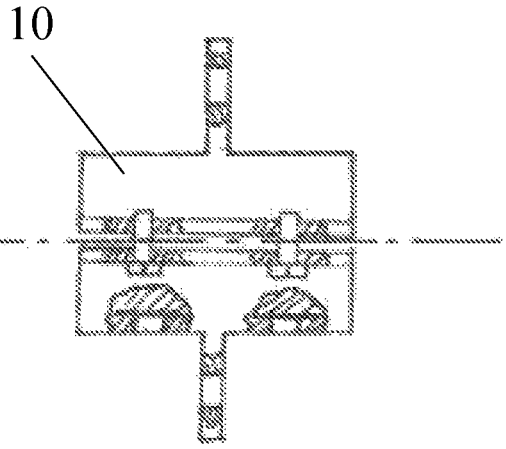
FIG. 10B is a side view of the sprocket flange 10 as seen in FIG. 10B with some cut-outs for ease of understanding.

The propulsion mechanism 9 comprises the central drive shaft 11 connected to the frame structure 3 by two bearing flanges 13 so that the central drive shaft 11 can rotate relative to the frame structure 3 (see FIG. 4). The central drive shaft 11 on each of its ends comprises a threaded portion 11A and a splines portion 11B (see FIG. 9B). The central drive shaft 11 on each of its ends further comprises a threaded bore 11C (see FIG. 9A). The central flange mount 10 is mounted onto the central drive shaft 11 and configured to fix the drive sprocket 10A thereto. The diameter of the sprocket is 150 mm. The propulsion mechanism 9 further comprises a drive unit 12 in the form of pedal drive, wherein the power from the pedals is transferred to the sprocket 10A mounted onto the central flange mount 10, in result of which the central drive shaft 11 can be rotated. The propulsion mechanism 9 further comprises two alignment shafts 15. Each alignment shaft 15 is connected to the central drive shaft 11 via threaded connection therebetween (see FIGS. 4 and 5). The propulsion mechanism 9 further comprises two side drive shafts 17. Each side drive shaft 17 is mounted to the frame structure 3 by means of at least two bearing flanges 13 and wherein each side drive shaft 17 is hollow so that it accommodates the alignment shaft 15 so that the side drive shaft 17 may rotate independently of the alignment shaft 15 (see FIG. 5). The alignment shaft 15 does not rotate and serves as one of the support members for the propulsion mechanism 9. The propulsion mechanism 9 further comprises a clutch mechanism 19 operatively connecting the central drive shaft 11 to each of side drive shafts 17 (see FIGS. 4 and 5).

Figure 8:
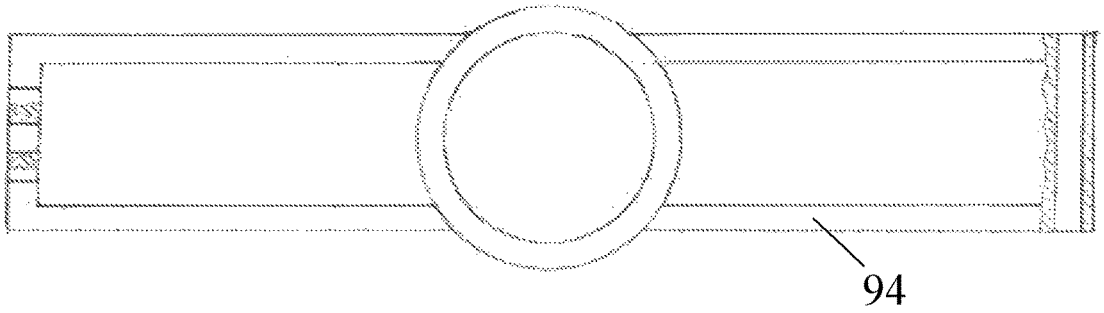
FIG. 8 illustrates the guide sleeve 94.
Figure 11:
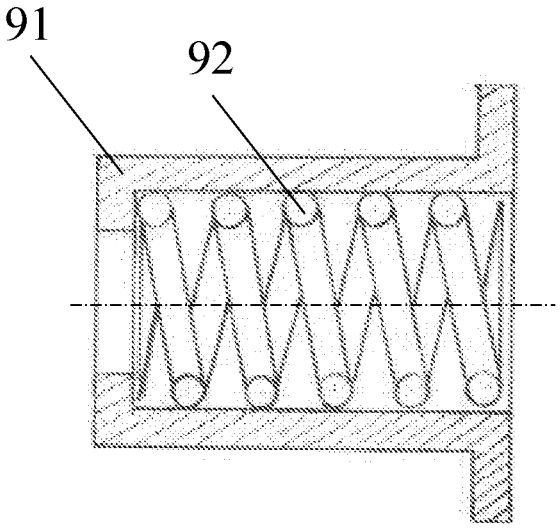
FIG. 11 is a cross-section view of the cup 91 with the spring 92 therein.
Figures 12A, 12B, 12C:
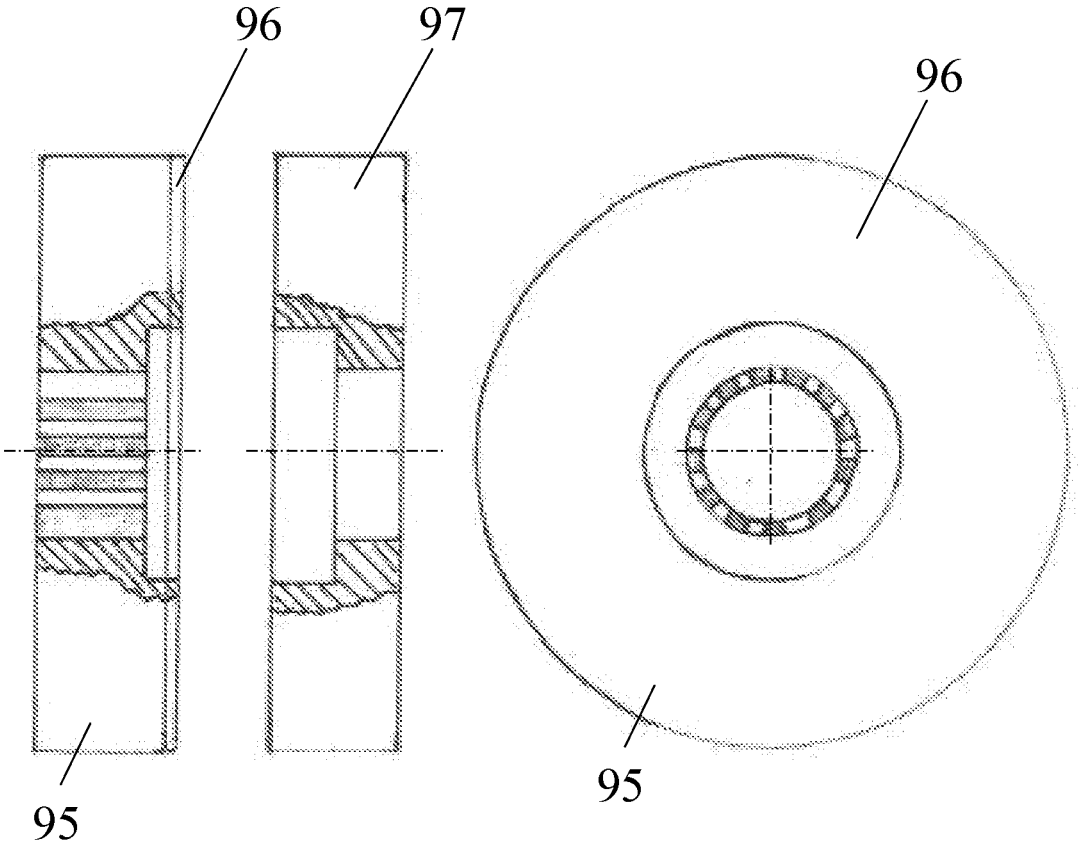
FIG. 12A is a side view of the drive flange 96 with the friction disc 96. The central part of the drive flange 96 is cut out to illustrate splines therein.
FIG. 12B is a side view of the driven flange 97. The central part of the driven flange 97 is cut out to illustrate the centre therein.
FIG. 12C is a front view of the drive flange 96 as seen in FIG. 12A.

The clutch mechanism 19 comprises the adjustment nut 90 screwed onto the threaded portion 11A of the central drive shaft 11. On the left side of the central drive shaft 11 there is right-hand thread, on the rights side of the central drive shaft 11 there is left-hand thread to avoid any loosening of theses threaded connections (see FIG. 4). The clutch mechanism 19 further comprises the cup 91 mounted onto the central drive shaft 11 and the support spring 92 mounted onto the central drive shaft 11 and arranged within the cup 91 (see FIGS. 4 and 11). The clutch mechanism 19 further comprises the releaser 93 with a guide sleeve 94 mounted onto the cup 91 so that upon the movement of the guide sleeve 94 the cup 91 is movable along the longitudinal axis of the central drive shaft 11 (see FIGS. 4 and 8). The clutch mechanism 19 further comprises the drive flange 95 in the form of a disc. The drive flange 95 is mounted onto the splines 11B of the central drive shaft 11. The drive flange 95 further comprises a friction disc 96 and the drive flange 95 is secured onto the central drive shaft 11 by means of a support nut 99 (see FIGS. 4, 12A and 12C). The clutch mechanism 19 further comprises a driven flange 97 fixed to the side drive shaft 17. The driven flange 97 comprises a flange bearing 98 to provide support of the driven flange 97 on the alignment shaft 15 (see FIGS. 4 and 12B).

Figures 5, 6, 7:
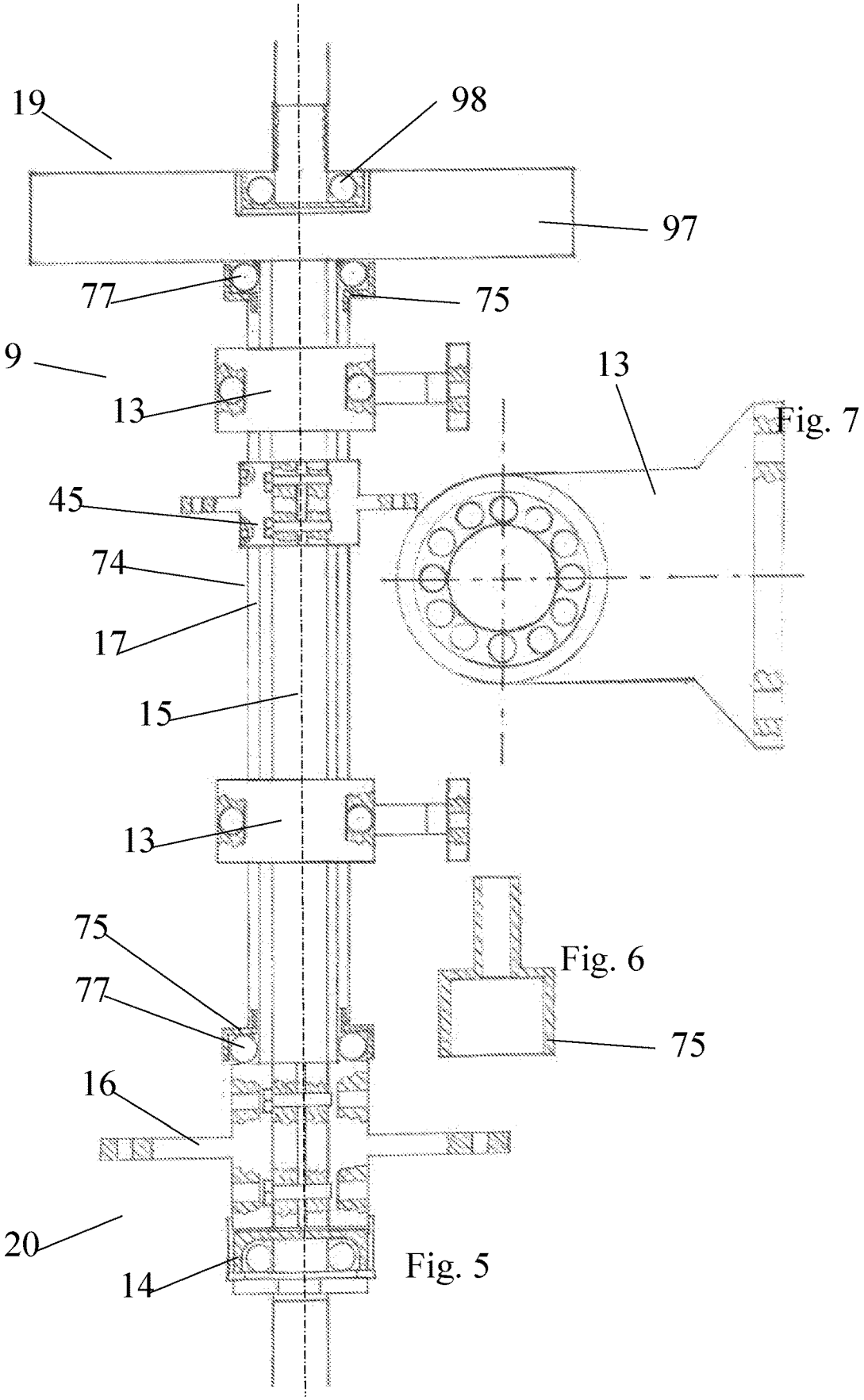
FIG. 5 illustrates another part of the drive mechanism 9, wherein FIGS. 4 and 5 together illustrate complete drive mechanism 9.
FIG. 6 is a cross-section view of the support cup 75.
FIG. 7 is a side view of the bearing flange 13.

The propulsion mechanism 9 further comprises two drive shaft sprocket flanges 16 with a sprocket 16A of each drive shaft sprocket flange 16 (see FIGS. 1 and 5). Each drive shaft sprocket flange 16 is fixed to the another end of the side drive shaft 17 transferring rotation of the side drive shaft 17 to the drive shaft sprocket flange 16. The support bearing 14 is positioned at the another end of the alignment shaft 15 to support thereof (see FIG. 5).

The paddle-wheel propulsion and steering mechanism 1 further comprises two side upward-downward moving mechanism tubes 74 (see FIG. 5). Each side upward-downward moving mechanism tube 74 is supported onto the respective side drive shaft 17 by means of bearings 77 and support cups 75 positioned on each end of the side upward-downward moving mechanism tube 74 and the side drive shaft 17, in result of which the side drive shaft 17 and the side upward-downward moving mechanism tube 74 can rotate relative to each other. The side drive shaft 17 rotates as a propulsion mechanism, but the side upward-downward moving mechanism tube 74 rotates to facilitate the upward-downward movement of the side paddle-wheel transmission mechanisms 20.

Figure 2A:
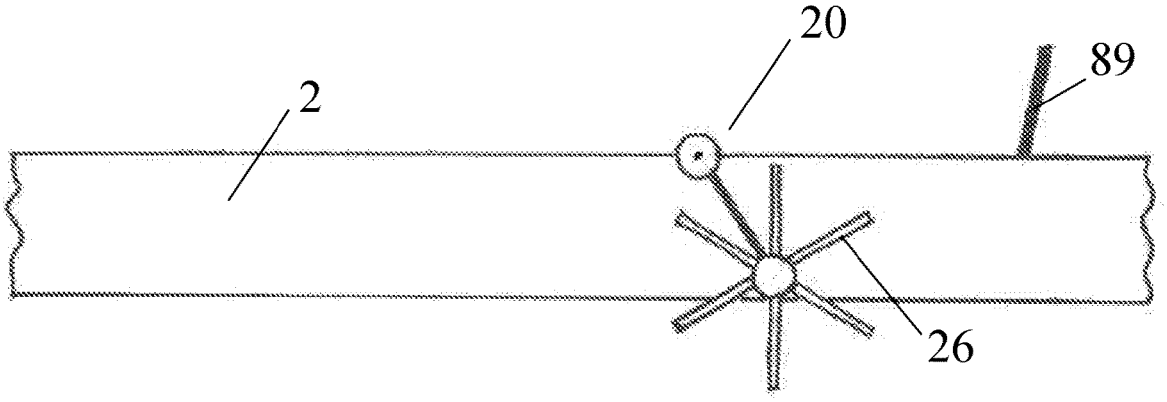
FIG. 2A is a side view of the boat 2 with a side paddle-wheel transmission mechanisms 20 in downward position.
Figure 2B:
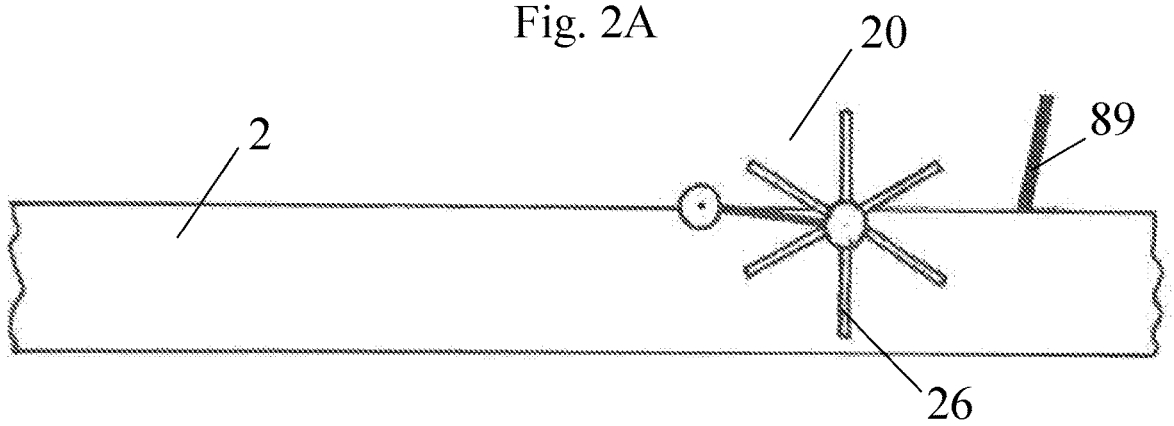
FIG. 2B is a side view of the boat 2 with a side paddle-wheel transmission mechanisms 20 in upward position.

The paddle-wheel propulsion and steering mechanism 1 comprises two side paddle-wheel transmission mechanisms 20 on each side (port side and starboard side) of the boat 2 (see FIGS. 1, 2A and 2B. Each side paddle-wheel transmission mechanism 20 comprises the arm 22 with one end fixed to the respective side upward-downward moving mechanism tube 74. The paddle wheel 24 comprises six paddles 26 set equally around the periphery of the paddle wheel 24.

The paddle wheel sprocket 28 is fixed to the paddle wheel 24 by means of bolts 27 and operatively connected to the sprocket 16A of the drive shaft sprocket flange 16 so that the rotation of the sprocket 16A of the drive shaft sprocket flange 16 is transferred to the paddle wheel sprocket 28 and further to the paddle wheel 24, thus propelling the boat 2. The spacer 29 of the paddle wheel 24 is arranged between the paddle wheel 24 and the paddle wheel sprocket 28. (see FIGS. 1, 14A, 14B and 15).

Figure 16:
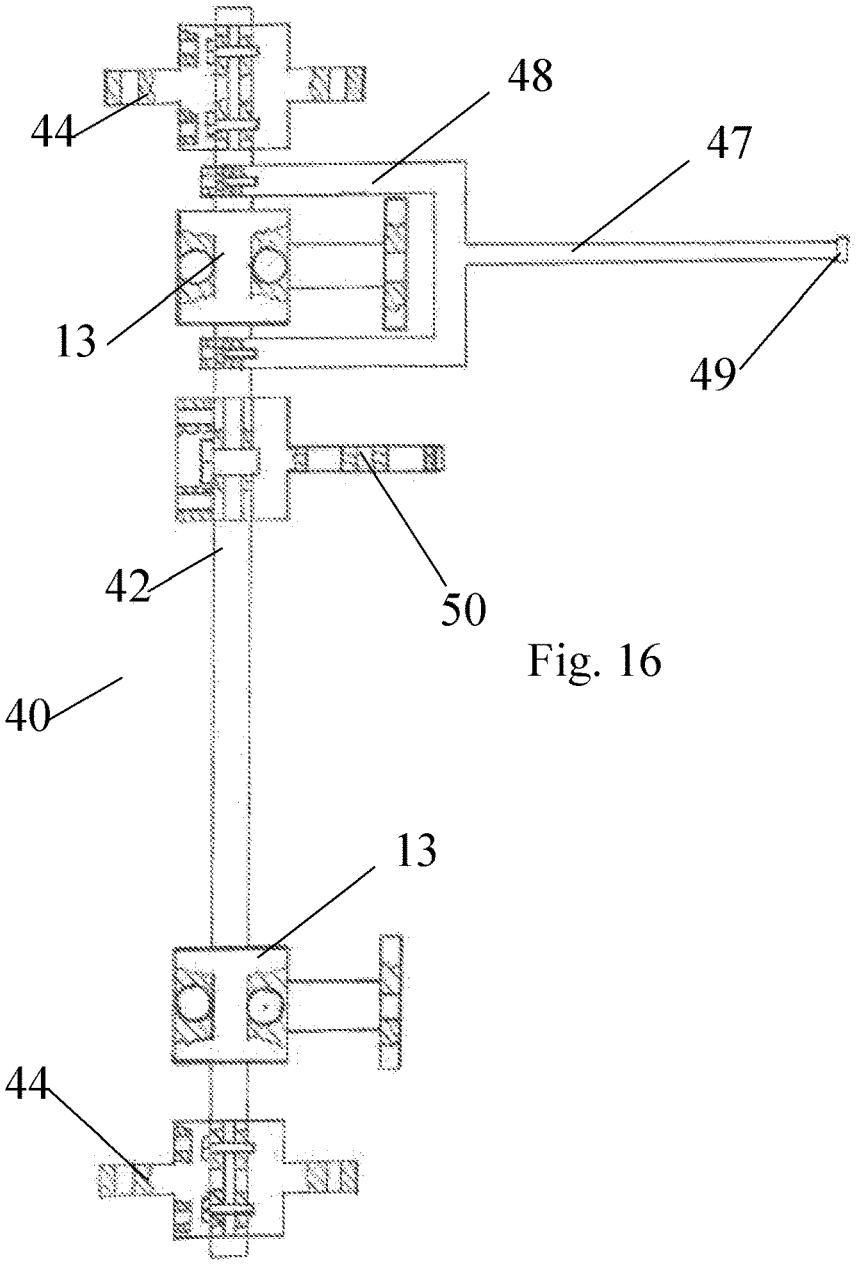
FIG. 16 illustrates part of the paddle-wheel upward-downward moving mechanism.
Figure 17A:
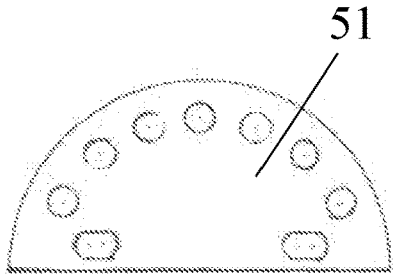
FIG. 17A is a side view of the frame fixation segment 51.
Figure 17B:
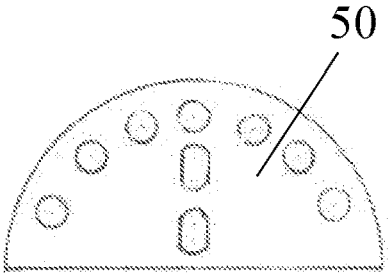
FIG. 17B is a side view of the shaft fixation segment 50.

The paddle-wheel upward-downward moving mechanism 40 comprises the shaft 42 that is connected to the frame structure 3 by means of two bearing flanges 13 and arranged parallel to the central drive shaft 11. The mechanism 40 further comprises two flange mounts 44 with a sprocket 44A on each flange mount 44. Each flange mount 44 with a sprocket 44A is fixed at each end of the shaft 42 of the mechanism 40. Each flange mount 44 with the sprocket 44A is connected to a respective sprocket 45A mounted onto the flange 45 of the side upward-downward moving mechanism tube 74 by means of a chain so that the side upward-downward moving mechanism tube 74 can be rotated by the rotation of the a shaft 42 of the paddle-wheel upward-downward moving mechanism 40 (see FIGS. 1, 5 and 16). The paddle-wheel upward-downward moving mechanism 40 further comprises a yoke 48 with a lever 47 and fixation button 49, wherein the yoke 48 is fixed to the shaft 42 of the paddle-wheel upward-downward moving mechanism 40. The shaft 42 of the mechanism 40 can be rotated by moving the yoke 48. Hence, the user of the boat 2 can control the paddle-wheel 24 position relative to a waterline. In order to fix the mechanism 40 in rotated position, the mechanism 40 further comprises the shaft fixation segment 50 fixed to the shaft 42; and a frame fixation segment 51 fixed to the frame structure 3 (see 16, 17A and 17B). The shaft fixation segment 50 and the frame fixation segment 51 are arranged so to provide fixation of the shaft 42 of the paddle-wheel upward-downward moving mechanism 40 after certain rotation of the shaft 42 which was performed by means of the yoke 48.

The steering mechanism 80 of the paddle-wheel propulsion and steering mechanism 1 comprises the main steering shaft 81 connected to the second frame structure 30 via at least two flange bearings 13. The main steering shaft 81 comprises one end and another, wherein the one end is located at the second frame structure 30 and another end is located at seat 89. The one end of the main steering shaft 81 is equipped with a fork 83 of the main steering shaft 81. The steering lever 82 fixed to another end of the main steering shaft 81. The steering mechanism 80 further comprises two steering rods 84. One end of each steering rod 84 is connected to the fork 83 of the main steering shaft 81 and another end of each steering rod 84 is connected to the guide sleeve 94, which in turn is connected to the clutch mechanism 19 to control engagement of the clutch mechanism 19. The main steering shaft 81 is also supported by a support 85 and auxiliary support 86. The steering lever 82 is fixed to another end of the main steering shaft 81 so that the up or down movement of the steering lever 82 is transferred to the main steering shaft 81 as a rotation thereof and rotation of the main steering shaft 81 via the fork 83 of the main steering shaft 81 is transferred as a linear movement to the respective steering lever 82, where the respective steering lever 82 controls the guide sleeve 94 in order to engage or disengage the clutch mechanism 19. (see FIGS. 1, 4, 8, 18, 19A, 19B, 19C, 19D, 20A, and 20B).

While particular embodiments of the invention have been shown and described, numerous variations alternate embodiments will occur to those skilled in the art.

The invention claimed is:

1. A paddle-wheel propulsion and steering mechanism (1) attachable to a boat (2), wherein the paddle-wheel propulsion and steering mechanism (1) comprises:

a first frame structure (3) comprising a frame (5) and an adapter (7) connected to the frame (5), wherein the adapter (7) has telescopic design so that the first frame structure (3) may be attachable to the boats (2) of different configurations, and wherein the first frame structure (3) is positioned generally transversely to the longitudinal axis of the boat (2);

a second frame structure (30) attached to and positioned generally transversely to the first frame structure (3);

a propulsion mechanism (9) comprising:

a central drive shaft (11) connected to the frame structure (3) by means of at least two bearing flanges (13), wherein the central drive shaft (11) on each end thereof comprises a threaded portion (11A) and a splines portion (11B);

a central flange mount (10) mounted onto the central drive shaft (11) and configured to fix a driven sprocket (10A) thereto;

a drive unit (12) connected to the central drive shaft (11) and configured to rotate the central drive shaft (11);

two alignment shafts (15), wherein one end of each alignment shaft (15) is screwed into the one end of the central drive shaft (11);

two side drive shafts (17), wherein each side drive shaft (17) is mounted to the frame structure (3) by means of at least two bearing flanges (13) and wherein each side drive shaft (17) is hollow so that it accommodates the alignment shaft (15) so that the side drive shaft (17) may rotate independently of the alignment shaft (15);

a clutch mechanism (19) configured to operatively connect the central drive shaft (11) to each of side drive shafts (17);

two drive shaft sprocket flanges (16) with a sprocket (16A) on each drive shaft sprocket flange (16), wherein each drive shaft sprocket flange (16) is fixed to the another end of the side drive shaft (17) transferring rotation of the side drive shaft (17) to the drive shaft sprocket flange (16) with the sprocket (16A);

a support bearing (14) positioned at the another end of each alignment shaft (15) to support thereof;

two side upward-downward moving mechanism tubes (74), wherein each side upward-downward moving mechanism tube (74) is supported onto the respective side drive shaft (17) by means of bearings (77) positioned on each end of the side upward-downward moving mechanism tube (74) and the side drive shaft (17);

two side paddle-wheel transmission mechanisms (20), wherein each side paddle-wheel transmission mechanism (20) comprises:

an arm (22) with one end fixed to the respective side upward-downward moving mechanism tube (74);

a paddle wheel (24) comprising at least six paddles (26) set around the periphery of the paddle wheel (24);

a paddle wheel sprocket (28) fixed to the paddle wheel (24) by means of bolts (27) and operatively connected to the sprocket (16A) of the drive shaft sprocket flange (16) so that the rotation of the sprocket (16A) of the drive shaft sprocket flange (16) is transferred to the paddle wheel sprocket (28) and further to the paddle wheel (24);

a paddle-wheel upward-downward moving mechanism (40) comprising:

a shaft (42) of the paddle-wheel upward-downward moving mechanism (40), wherein the shaft (42) is connected to the frame structure (3) by means of at least two bearing flanges (13) and arranged parallel to the central drive shaft (11);

two flange mounts (44) with a sprocket (44A) on each flange mount (44), wherein each flange mount (44) with a sprocket (44A) is fixed on each end of the shaft (42) of the paddle-wheel upward-downward moving mechanism (40), wherein each flange mount (44) with the sprocket (44A) is connected to a respective sprocket (45A) mounted onto the flange (45) of the side upward-downward moving mechanism tube (74) by means of a chain so that the side upward-downward moving mechanism tube (74) can be rotated by the rotation of the a shaft (42) of the paddle-wheel upward-downward moving mechanism (40);

a yoke (48) fixed to the shaft (42) of the paddle-wheel upward-downward moving mechanism (40); and a steering mechanism (80) comprising:

a main steering shaft (81) connected to the second frame structure (30) via at least two flange bearings (13), wherein the main steering shaft (81) comprises one end and another end equipped with a fork (83) of the main steering shaft (81);

a steering lever (82) fixed to another end of the main steering shaft (81);

two steering rods (84), wherein one end of each steering rod (84) is connected to the fork (83) of the main steering shaft (81) and another end of each steering rod (84) is connected to the guide sleeve (94), wherein the steering lever (82) is fixed to another end of the main steering shaft (81) so that the up or down movement of the steering lever (82) is transferred to the main steering shaft (81) as a rotation thereof and rotation of the main steering shaft (81) via the fork (83) of the main steering shaft (81) is transferred as a linear movement to the respective steering lever (82), where the respective steering lever (82) controls the guide sleeve (94) in order to engage or disengage the clutch mechanism (19).

2. The paddle-wheel propulsion and steering mechanism (1) according to claim 1 characterized in that the clutch mechanism (19) comprises:

an adjustment nut (90) screwed onto the threaded portion (11A) of the central drive shaft (11);

a cup (91) mounted onto the central drive shaft (11);

a support spring (92) mounted onto the central drive shaft (11) and arranged within the cup (91);

a releaser (93) with a guide sleeve (94) mounted onto the cup (91) so that upon the movement of the guide sleeve (94) the cup (91) is movable along the longitudinal axis of the central drive shaft (11);

a drive flange (95) mounted onto the splines (11B) of the central drive shaft (11), the drive flange (95) further comprises a friction disc (96) and the drive flange (95) is secured onto the central drive shaft (11) by means of a support nut (99); and a driven flange (97) fixed to the side drive shaft (17), wherein the driven flange (97) comprises a flange bearing (98) to provide support of the driven flange (97) on the alignment shaft (15).

3. The paddle-wheel propulsion and steering mechanism (1) according to claim 1 characterized in that the drive unit (12) is connected to the central drive shaft (11) via the drive sprocket (10A) of the central flange mount (10).

4. The paddle-wheel propulsion and steering mechanism (1) according to claim 1 characterized in that the drive unit (12) is connected to the central drive shaft (11) via belt drive, a cardan drive or a gear drive.

5. The paddle-wheel propulsion and steering mechanism (1) according to claim 1 characterized in that the drive unit is powered by an electric motor or by a muscle power of a user of the boat.

6. The paddle-wheel propulsion and steering mechanism (1) according to claim 1 characterized in that the steering lever (82) of the steering mechanism (80) is provided with an electrical or hydraulic power steering to augment steering effort.

7. The paddle-wheel propulsion and steering mechanism (1) according to claim 1 characterized in that the yoke (48) of the paddle-wheel upward-downward moving mechanism (40) is provided with an electrical or hydraulic power to augment upward-downward moving effort.

8. The paddle-wheel propulsion and steering mechanism (1) according to claim 1 characterized in that the paddle-wheel upward-downward moving mechanism (40) further comprises a shaft fixation segment (50) fixed to the shaft (42) and a frame fixation segment (51) fixed to the frame structure (3), wherein the shaft fixation segment (50) and the frame fixation segment (51) are arranged to provide fixation of the shaft (42) of the paddle-wheel upward-downward moving mechanism (40) after certain rotation of the shaft (42) by means of the yoke (48).

* * * * *